United States Patent [19]

Sirota

[11] Patent Number: 4,570,650

[45] Date of Patent: Feb. 18, 1986

[54] CIGARETTE

[76] Inventor: Vladimir Sirota, 263 Congressional La., Rockville, Md. 20852

[21] Appl. No.: 518,058

[22] Filed: Jul. 28, 1983

[51] Int. Cl.[4] ..... A24D 1/02; A24D 1/10; A24D 1/11

[52] U.S. Cl. ..... 131/349; 131/361; 131/362

[58] Field of Search ..... 131/349, 360, 361, 362, 131/365, 270

[56] References Cited

U.S. PATENT DOCUMENTS 4,121,597 10/1978 Shin ..... 131/349

FOREIGN PATENT DOCUMENTS 0694631 9/1964 Canada ..... 131/349

2120586 11/1972 Fed. Rep. of Germany ..... 131/349

0348094 9/1960 Switzerland ..... 131/349

*Primary Examiner*—Millin V.

*Attorney, Agent, or Firm*—Ilya Zborovsky

[57] ABSTRACT

A cigarette has a front tobacco-containing part composed of a tubular member of cigarette paper and a tobacco filler, a rear part extending rearwardly from the front part and having a filter, and a tubular coating extending around at least one fourth of the length of the front part from the rear end of the latter, so as to extinguish the cigarette when the flame reaches this region and prevent smoking of the cigarette in this region. The tubular coating is formed of one piece with a tubular connector which connects the filter with the tobacco-containing part of the cigarette.

11 Claims, 7 Drawing Figures

CIGARETTE

BACKGROUND OF THE INVENTION

The present invention relates to cigarettes.

It is well known that not extinguished cigarettes are one of major sources of fires. A user often forgets to extinguish a cigarette, the flame propagates up to the cigarette filter, and inflames surrounding objects. When a cigarette is left lying on an edge of an object and it burned up to its rear third, its center of gravity displaces toward the filter and it falls onto a table, carpet, armchair etc thus causing fire. Moreover, smoking of a cigarette in its rear one third is very health hazardous, because this part concentrates hazardous substances from the front two thirds of the cigarette. Phycisians always recommend that if a person cannot quit smoking completely, he should at least not to smoke the rear one third of the cigarettes.

U.S. Pat. No. 4,121,587 discloses a cigarette in which an additional fire-protection coating is provided. This coating is formed, however, as a separate part, which makes the manufacture of the cigarette more complicated and the cigarette more expensive.

SUMMARY OF THE INVENTION

Accordingly, it is an object of the present invention to provide a cigarette which avoids the disadvantages of the prior art.

More particularly, it is an object of the present invention to provide a cigarette which possesses self-extinguishing properties and therefore is less dangerous in the sense of causing fires.

It is also an object of the present invention to provide a cigarette which is less health hazardous to a smoker.

In keeping with these objects and with others which will become apparent hereinafter, one feature of the present invention resides, briefly stated, in a cigarette which has a tubular coating extending from the rear end of a front tobacco-containing part forwardly over a length which is equal to at least one fourth of the length of the front part and the tubular coating is of one piece with the connector which connects the filter with the tobacco part.

When in accordance with the present invention a region of $\frac{1}{4}$ or $\frac{1}{3}$ at the rear of the front tobacco-containing part is covered by the inventive tubular coating, a tobacco flane reaches a front edge of the tubular coating which forms a less air permeable region, propagates slightly inside the tubular coating and because of lower air permeability of the latter the flame extinguishes. A known tubular connector which connects the filter part with the tobacco-containing part of a cigarette cannot perform these functions since it extends only over 3–4 mm of the tobacco-containing part. The extinguising effect of the present invention is attained because at least $\frac{1}{4}$ the length of the front tobacco-containing part of the cigarette is covered by the tubular coating. The inventive tubular coating also does not permit a smoker to smoke the remaining rear part of the cigarette, namely $\frac{1}{4}$–$\frac{1}{3}$ of it, which is the most hazardous to his health.

When the tubular coating is formed in accordance with the present invention of one piece with the connector which connects the filter with the tobacco-containing part of the cigarette, the cigarette is easy to manufacture and is inexpensive as compared with the cigarettes having coatings which are formed as separate members.

The novel features of the present invention are set forth in the appended claims. The invention itself will be best understood from the following description accompanied by the following drawing.

DESCRIPTION OF PREFERRED EMBODIMENTS

Figure 1:
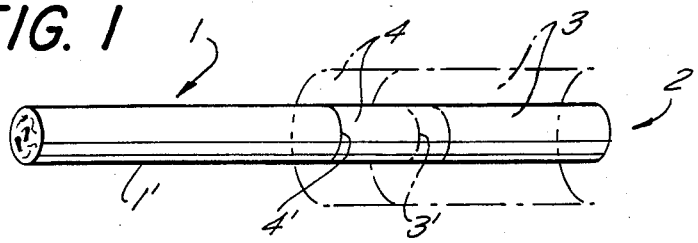
FIG. 1 is a view schematically showing a cigarette in accordance with a present invention, with an inventive tubular coating formed of one piece with a tubular connector for connecting front and rear cigarette parts.

A cigarette shown in FIG. 1 has a front tobacco-containing part which is identified as a whole with reference numeral 1 and a rear filter part which is identified as a whole with reference numeral 2. The front part is composed, as known, of a tubular member of a cigarette paper 1' and a not shown tobacco filler accommodated inside the latter. A tubular connector 3 connects the front part 1 with the rear part 2. It is shown in a preparatory position before wrapping in dot-dash lines and after wrapping in solid lines. The tubular connector 3 covers a rear portion of the front part 1 so as to extend by 3–4 mm from the rear end of the front part. A front end of the tubular connector is identified with reference numeral 3'. A tubular coating identified with reference numeral 4 is further provided. Its front end is identified with reference numberal 4'. The tubular coating is shown in a preparatory position before wrapping in dot-dash lines and after wrapping in solid lines. In the embodiment shown in FIG. 1 the tubular coating 4 is of one piece with the tubular connector 3 so as to form an integral member. This integral member covers the rear filter part 2 and also a rear portion of the front tobacco-containing part 1 over a length which is at least equal to $\frac{1}{4}$ the length of the front part 1. Advantageously, this integral member covers $\frac{1}{3}$ of the front part 1. The tubular coating 4 is composed of a material which is different as compared with the cigarette paper of the tubular member 1'. The material of the tubular coating 4 can be thicker, less air permeable and therefore more fire resistant than the material of the tubular member 1'.

Figure 2A:
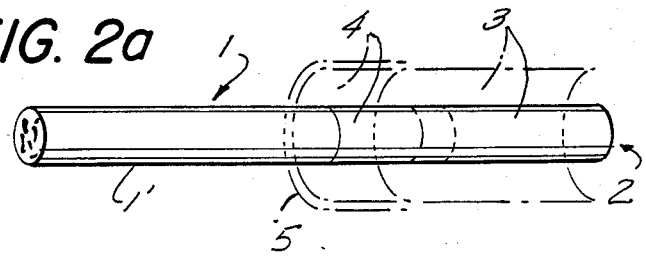
FIG. 2 is a view schematically showing a cigarette in accordance with another embodiment of the present invention, with a portion of the tubular coating provided with a fire resistant layer.
Figure 2B:
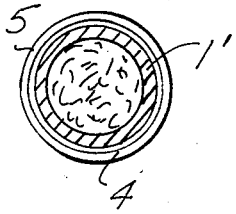

A cigarette in accordance with another embodiment shown in FIG. 2 substantially corresponds to the cigarette of FIG. 1 in that the tubular coating 4 is here also formed of one piece with the tubular connector 3. However, in the embodiment of FIG. 2 the tubular coating 4 is provided with an additional fire resistant material identified by reference numeral 5. The fire resistant material can be formed as a thin film for example an aluminum foil, an electro-chemically deposited layer on the surface of the tubular coating, an impregnated material by diffussion etc. It is advantageous when the material 5 is heatable so that a user can feel the heat when this material is heated.

When the tubular coating 4 is formed of one piece with the tubular connector 3 so as to form the above mentioned integral member, not only fire of a cigarette is prevented and a smoker cannot smoke the last part of the cigarette which is the most health hazardous, but also the manufacture of the cigarette is easy and inexpensive, and therefore the cost of the cigarette is not increased as a result of provision of the tubular coating.

Figure 3:
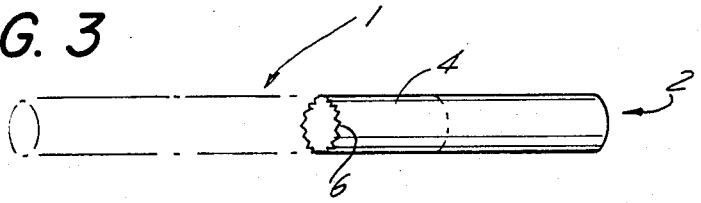
FIGS. 3 and 4 show cigarettes in which the tubular coating has special formations in its front part.
Figure 4:
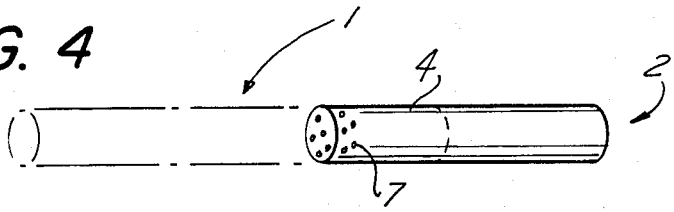

Cigarettes in accordance with two further embodiments shown in FIGS. 3 and 4 are somewhat different from the cigarettes of the preceding FIGS. The cigarette shown In FIG. 3 has the tubular coating provided at it front end with a plurality of teeth-like projections, whereas the tubular coating 4 of the cigarette shown in FIG. 4 has a front end portion provided with a plurality of perforations. The projections are identified with reference numeral 6, whereas the perforations are identified with reference numeral 7. These formations force the flame to go deeper into the tubular coating 4, so as to increase fire safety of the cigarette. When the cigarette is provided with these formations a smoker can squeeze the front end portion of the tubular coating to extinguish the flame. It has also been found that when these formations are provided the front end of the tubular coating 4 tends to compress by itself and to close itself.

Figure 5:
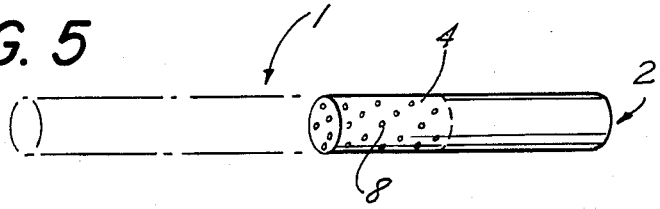
FIG. 5 is a view showing an inventive cigarette in which the tubular coating is provided with a plurality of perforations.
Figure 6:
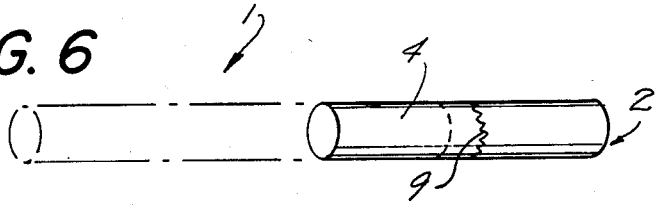
FIG. 6 is a view schematically showing still a further embodiment of the invention, wherein the tubular coating is provided with special formations at its rear end facing toward a filter.

In a cigarette shown in FIG. 5 the tubular coating 4 is provided with a plurality of perforations 8 which are distributed over the entire length of the tubular element.

It is to be understood that the embodiments shown can be combined with one another. The teeth and perforations as well as the fire resistant layer can be formed on the tubular coating with each either of one piece with the tubular connector or separate therefrom. One cigarette can include the front teeth, the rear teeth, the perforations over the entire tubular coating, the fire resistant layer, or only some of these features.

The invention is not limited to the details shown since various modifications and structural changes are possible without departing in any way from the spirit of the present invention.

What is desired to be protected by Letters Patent is set forth in particular in the appended claims.

I claim:

1. A cigarette, comprising a front part including a tubular member which is composed of a cigarette paper, and a tobacco filler accommodated in said tubular member, said front part having front and rear ends and a predtermined length therebetween; a rear part extending rearwardly from said rear end of said front part and having a filter, said front part and said rear part being in abutting relationship to one another over said rear end of said front part and a front end of said rear part; and a one-piece element extending over said rear part and further forwardly beyond said rear end of said front part over said front part partially over its length, said one-piece element immovably connecting said rear part with said front part and being provided with a fire resistant layer applied over at least a portion of its length, so that said one-piece element forms simultaneously a tubular connector connecting said front and rear parts with one another and a tubular coating which extinguishes a tobacco fire after burning of said front part.

2. A cigarette as defined in claim 1, wherein said one-piece element extends from said rear end of said front part over a length substantially equal to $\frac{1}{3}$ the length of said front part.

3. A cigarette as defined in claim 1, wherein said fire resistant layer applied on said one-piece element is formed as a layer of a fire resistant substance.

4. A cigarette as defined in claim 1, wherein said fire resistant layer is heatable upon approach of tobacco fire thereto, so that when a user holds cigarette in his fingers he feels the heat of said fire resistant layer, thus obtaining a signal about fire propagation to said layer.

5. A cigarette as defined in claim 1, wherein said one-piece element has a front end portion which is provided with a plurality of perforations.

6. A cigarette as defined in claim 1, wherein said one-piece element has a front end which is provided with a plurality of teeth-like projections extending forwardly therefrom.

7. A cigarette as defined in claim 1, wherein said one-piece element has a plurality of perforations which are distributed substantially uniformly over its entire length.

8. A cigarette as defined in claim 1, wherein said fire resistant layer provided on said one-piece element is formed as a metal foil.

9. A cigarette as defined in claim 1, wherein said fire resistant layer on said one-piece element is formed as an electro-chemically deposited layer.

10. A cigarette as defined in claim 1, wherein said fire resistant layer is formed as a material impregnated by diffussion into said one-piece element.

11. A cigarette as defined in claim 1, wherein said additional layer applied on said one piece element is formed as a separate part arranged on and connected with said one piece element.

* * * * *